United States Patent [19]

Fraulo et al.

[11] Patent Number: 5,038,121

[45] Date of Patent: Aug. 6, 1991

[54] MOLDED CASE CIRCUIT INTERRUPTER TRIP INDICATING HANDLE

[75] Inventors: Victor G. Fraulo, Rocky Hill; David J. Lesslie, Plainville; Michael C. Guerrette, Plymouth; Andrew M. Candelora, East Haven; Dennis J. Doughty, Plainville, all of Conn.

[73] Assignee: General Electric Company, New York, N.Y.

[21] Appl. No.: 558,909

[22] Filed: Jul. 27, 1990

[51] Int. Cl.[5] ..... H01H 73/12

[52] U.S. Cl. ..... 335/17; 200/304

[58] Field of Search ..... 335/6-10, 335/35, 17, 172-176; 200/293-305, 308

[56] References Cited

U.S. PATENT DOCUMENTS 4,266,209 5/1981 Di Marco et al. ..... 335/35
4,644,122 2/1987 Farley et al. ..... 200/304
4,736,174 4/1988 Castonguay et al. ..... 335/167
4,843,359 6/1989 Morris et al. ..... 335/6

*Primary Examiner*—Leo P. Picard
*Assistant Examiner*—Lincoln Donovan
*Attorney, Agent, or Firm*—Richard A. Menelly; Walter C. Bernkopf; Fred Jacob

[57] ABSTRACT

An operating handle assembly for molded case circuit interrupters is robotically assembled to the circuit breaker operating mechanism without requiring any auxiliary fastening device. A visual access slot in the circuit breaker cover allows the condition of the circuit breaker contacts to be visually ascertained by use of colored indicia carried by the operating handle skirt. A slidably mounted handle shutter cooperates with the operating handle to prevent egress of arc exhaust gases in the event the circuit breaker contacts are closed or opened during overcurrent conditions when the circuit breaker is installed within an industrial power distribution circuit.

9 Claims, 5 Drawing Sheets

10

MOLDED CASE CIRCUIT INTERRUPTER TRIP INDICATING HANDLE

BACKGROUND OF THE INVENTION

Compact electronic circuit breakers such as described in U.S. Pat. No. 4,736,174 utilize an electronic trip unit contained within the circuit breaker cover to interrupt the circuit current upon the occurrence of an overcurrent condition for a predetermined period of time. The circuit breaker operating mechanism, such as described in U.S. Pat. No. 4,736,174 is robotically assembled in a down-loaded operation at a substantial savings of manufacturing time. The circuit breaker operating handle described in U.S. Pat. No. 4,843,359 is robotically assembled onto the operating mechanism and is fastened to the mechanism in a pre-assembly process.

U.S. patent application Ser. No. 546,826 entitled "Compact Molded Case Circuit Breaker with Increased Ampere Rating" describes a circuit breaker operating handle containing a pair of handle shutters for preventing egress of exhaust arc gases one of which includes colored indicia to provide visual indication of the condition of the circuit breaker contacts.

One purpose of the instant invention is to provide a molded case circuit breaker having operating components that are robotically assembled and which includes a handle operator requiring a single shutter for preventing the egress of arc exhaust gases.

SUMMARY OF THE INVENTION

The invention comprises a handle operator assembly for molded case circuit breakers which includes a molded plastic handle operator and single shutter arrangement whereby a pair of runners formed on the handle operator cooperates with a corresponding pair of rails formed within the interior surface of the circuit breaker handle escutcheon to allow for reciprocal movement of the handle operator. The shutter is positioned over the handle operator and is trapped between the top of the handle operator and bottom interior of the handle escutcheon.

DESCRIPTION OF THE PREFERRED EMBODIMENT

Figure 1:
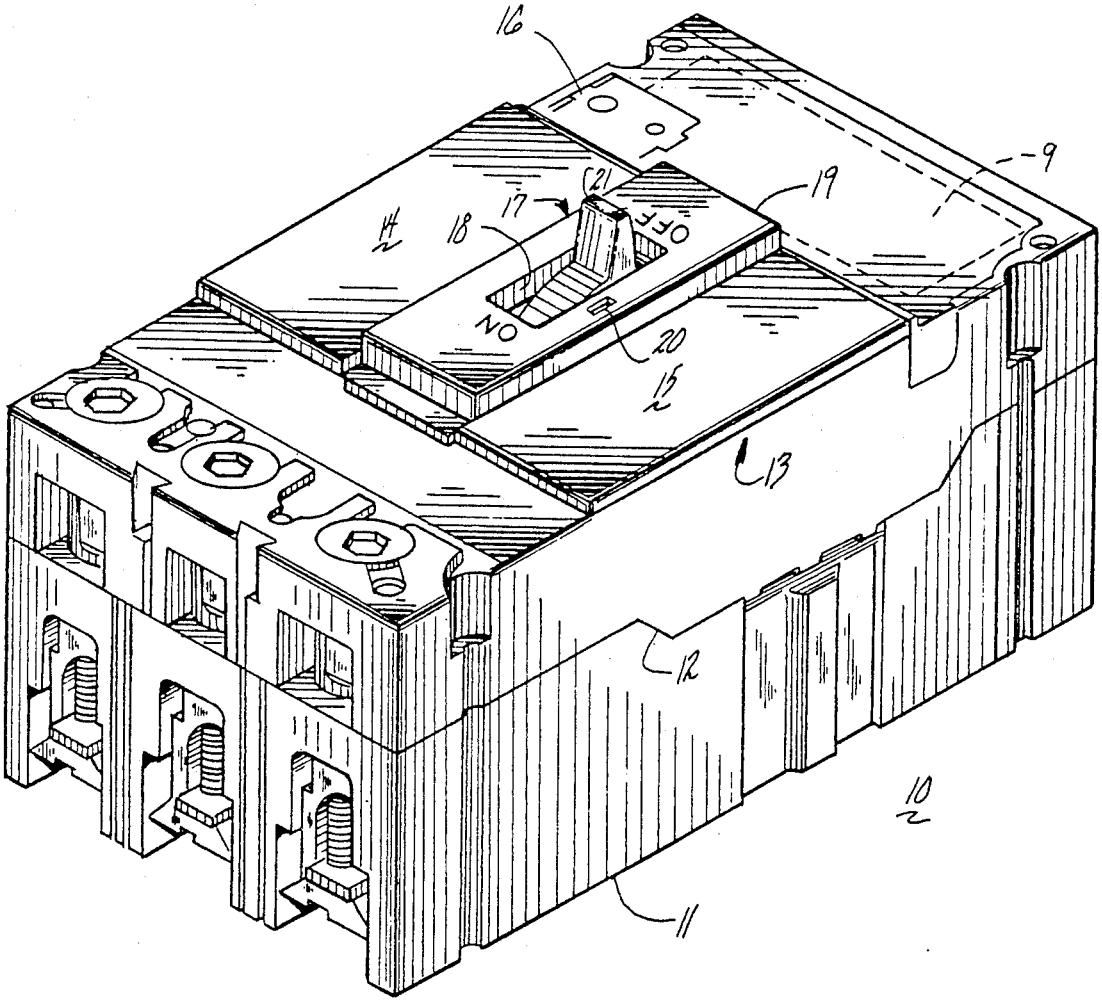
FIG. 1 is a top perspective view of the electronic trip circuit breaker containing the operating handle assembly in accordance with the invention.

A compact electronic trip circuit breaker 10, hereafter "electronic circuit breaker", is shown in FIG. 1 and includes a molded plastic case 11 to which a cover 12 is fixedly attached. An accessory cover 13 is positioned over the circuit breaker cover and allows access to an optional accessory and an accessory-actuator unit by means of the accessory doors 14, 15. An electronic trip unit 9 is positioned under the accessory cover and a rating plug 16 electrically communicates with the trip unit to set the circuit breaker ampere rating. An operating handle assembly 17 is positioned within the circuit breaker cover and external access to the assembly is made by means of the upstanding post 21 which extends through the handle access slot 18 formed in the handle escutcheon 19 upstanding upon the circuit breaker cover.

Figure 2:
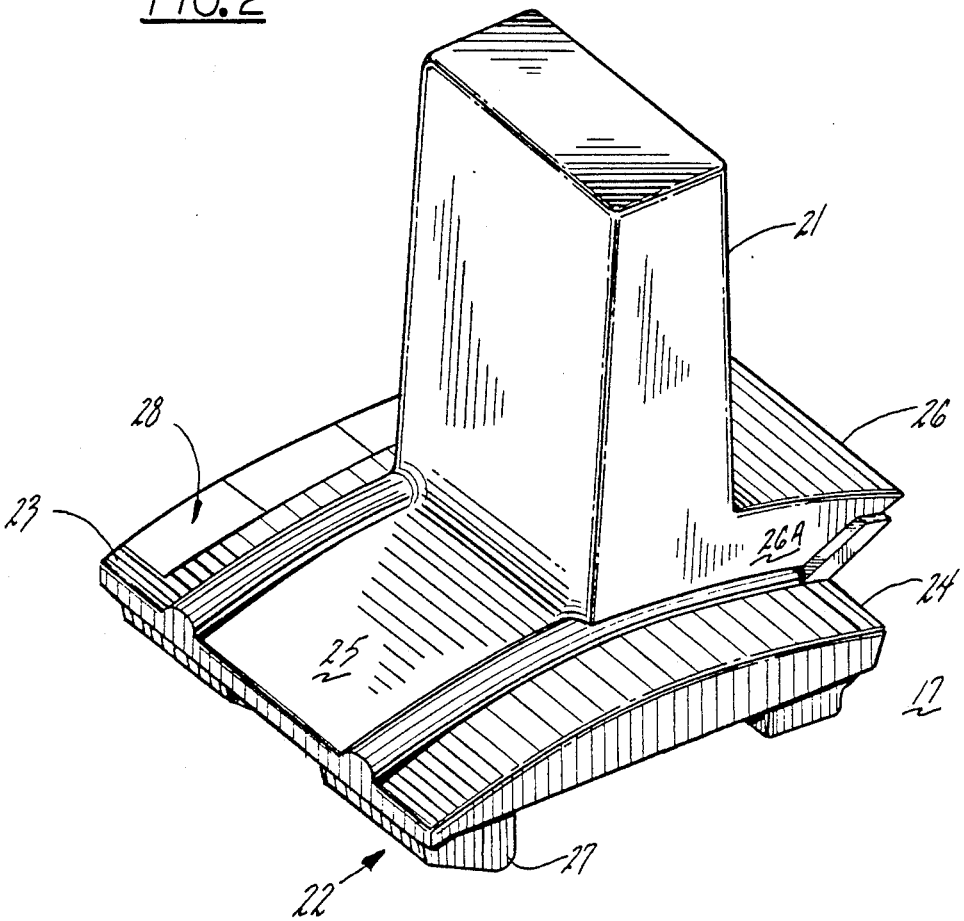
FIG. 2 is an enlarged top perspective view of the handle operator within the handle operator assembly contained within the electronic trip circuit breaker of FIG. 1.
Figure 3:
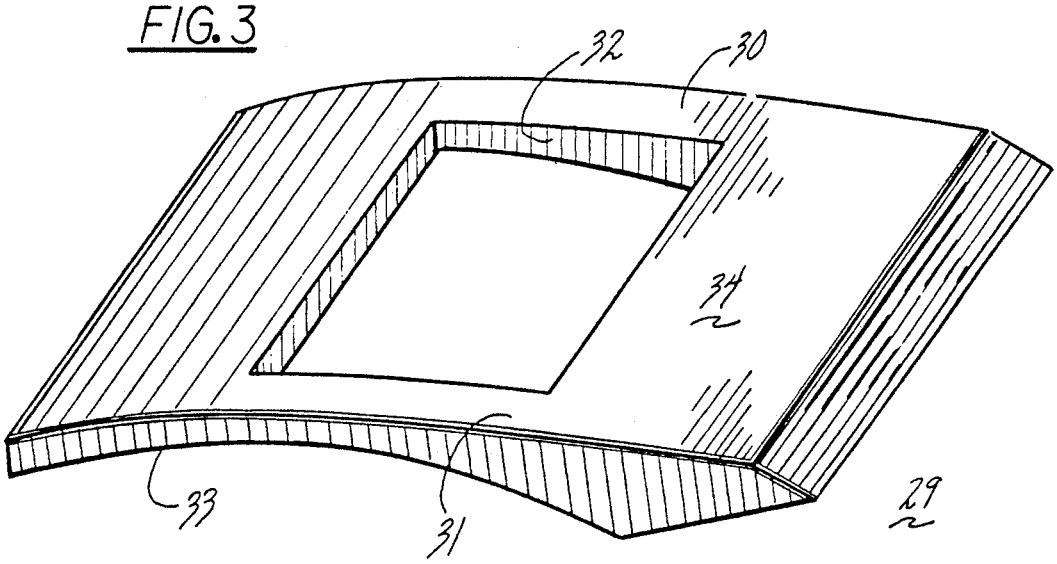
FIG. 3 is an enlarged top perspective view of the shutter used with the handle operator assembly contained within the electronic trip circuit breaker of FIG. 1.

The operating handle assembly 17 is shown in FIGS. 2 and 3 and consists basically of the upstanding post 21 integrally-formed with a skirt portion 22. A pair of handle runners 23, 24, cooperate with corresponding tracks 41 formed on the inner surface of the handle escutcheon 19 (FIG. 5) to allow the reciprocal motion of the post 21 within the access slot 18. Colored indicia 28 formed on one of the handle runners provides external indication as to the operating condition of the breaker contacts when viewed through the status viewing slot 20 formed within the handle escutcheon 19 shown earlier in FIG. 1. The skirt 22 includes a forward angulated part 26 raised above a rear radial surface 25 which defines raised edges 26A on the sides of the angulated part to interact with the shutter 29 to prevent the egress of arc exhaust gases through the handle access slot 18 as best seen by referring now to FIGS. 2 and 3. The handle post 21 and sides 26A of the forward angulated part 26 extend up within the handle slot with the sides engaged with the edges of the slot 32 in a press-fit relation to ensure a tight seal between the edges of the handle slot and the sides of the angulated part. The provision of the indicia 28 on the handle runner 23 is an important feature of the invention and represents a significant cost savings. Previous circuit breaker operating handle assemblies that included a separate shutter for blocking the handle opening, also required an additional shutter to carry the colored indicia. The provision of the viewing window 20 shown in FIG. 1, outboard the shutter 29, allows visual access to the three components of the colored indicia located on the runner 23 of the handle assembly.

Figure 4:
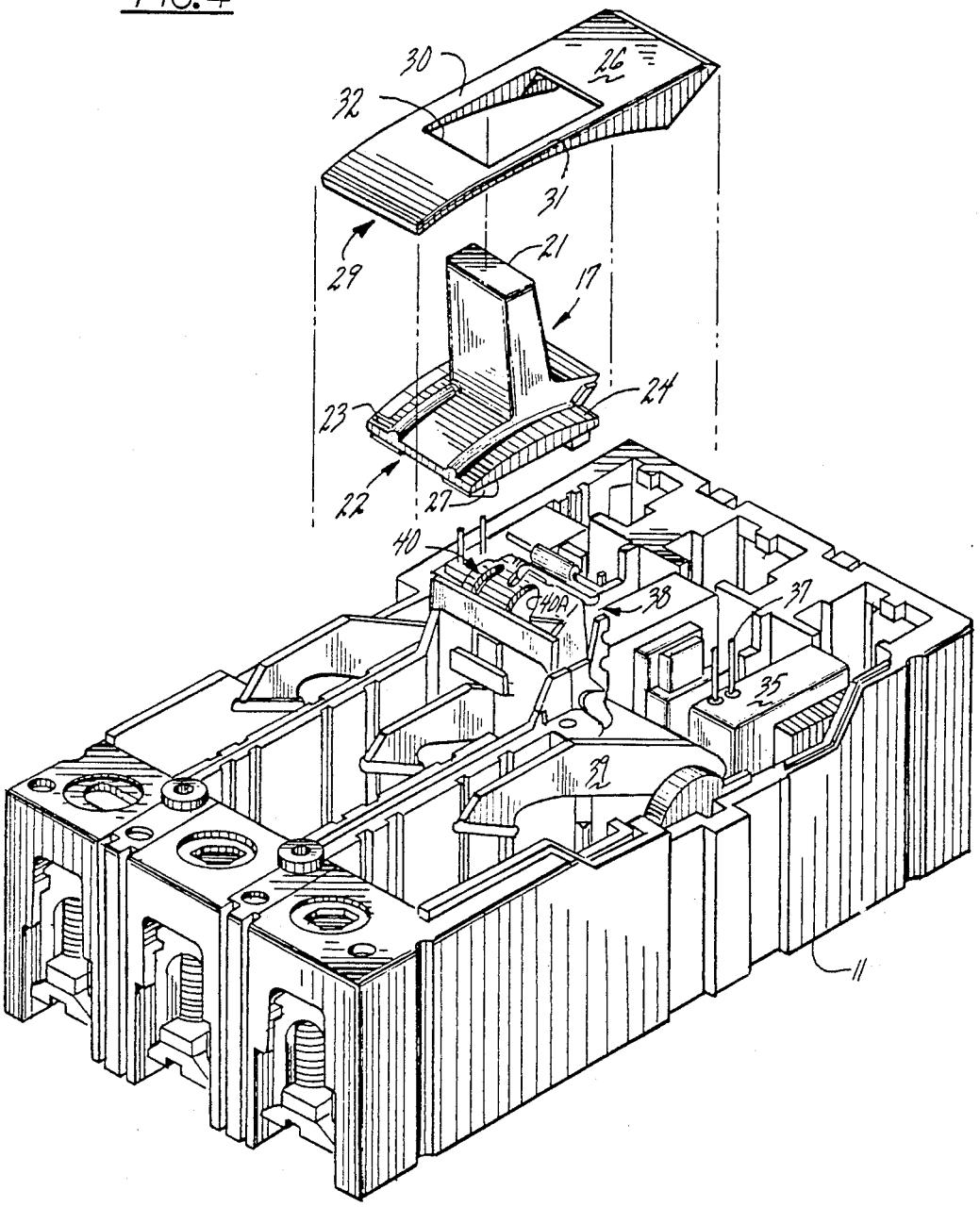
FIG. 4 is a top perspective view of the circuit breaker case of FIG. 1 with the handle operator assembly and shutter in isometric projection.

The four depending projections 27 integrally-formed on the bottom surface of the handle skirt 22 are received within corresponding slots 40A formed within the operating mechanism handle 40 (FIG. 4). Referring to FIGS. 2, 3 and 4, the shutter 29 includes a radial bottom portion 33 that sits upon the radial surface 25 of the handle skirt 22 and a forward planar shelf 34 that overhangs the forward angulated part 26 of the handle skirt 22. The shutter is attached to the operating handle assembly by positioning the rectangular slot 32 formed within the shutter over the upstanding post 21 projecting from the handle skirt. The runners 30, 31 on opposing sides of the rectangular slot become trapped between the edges 26A of the angulated part of the handle skirt and the guides 42 (FIG. 5) formed on the interior surface of the handle escutcheon 19 in a manner that will be described below in greater detail. The combination of the radial bottom portion and the planar shelf provides a multi-planar configuration to the shutter whereby a single shutter is now capable of providing the function required by two or more prior art shutters. This reduction in the number of shutters represents a cost savings as well as allowing valuable space-savings within the environment of the handle escutcheon.

Referring now to FIG. 4, the circuit breaker case 11 is depicted prior to assembly of the operating handle assembly 17 and the handle shutter 29. The current transformers 35 are depicted with pin connectors 37 upstanding from the top of the current transformers for electrically connecting with the electronic trip unit 9 shown earlier in FIG. 1. The circuit breaker operating mechanism 38, which is similar to that described within aforementioned U.S. Pat. No. 4,736,174 interacts with the electronic trip unit to drive the movable contact arms 39 to the open position shown in FIG. 4 upon occurrence of an overcurrent condition for a predetermined period of time. To assemble the shutter and operating handle assembly to the circuit breaker operating mechanism, the shutter 29 is first positioned over the operating handle assembly 17 by capturing the post 21 within the rectangular slot 32 and positioning the shutter runners 30, 31 on the shutter 29 over the handle runners 23, 24 on the operating handle assembly 17. The press-fit relation between the sides of the forward angulated part 26 and the corresponding edges of the rectangular slot 32 allows the shutter and operating handle assembly to be loaded as a unitary assembly onto the handle yoke 40. As described earlier, the projections 27 depending from the handle skirt 22 are received within four corresponding slots 40A formed within the handle yoke to position and support the shutter and handle assembly on the operating mechanism.

Figure 5:
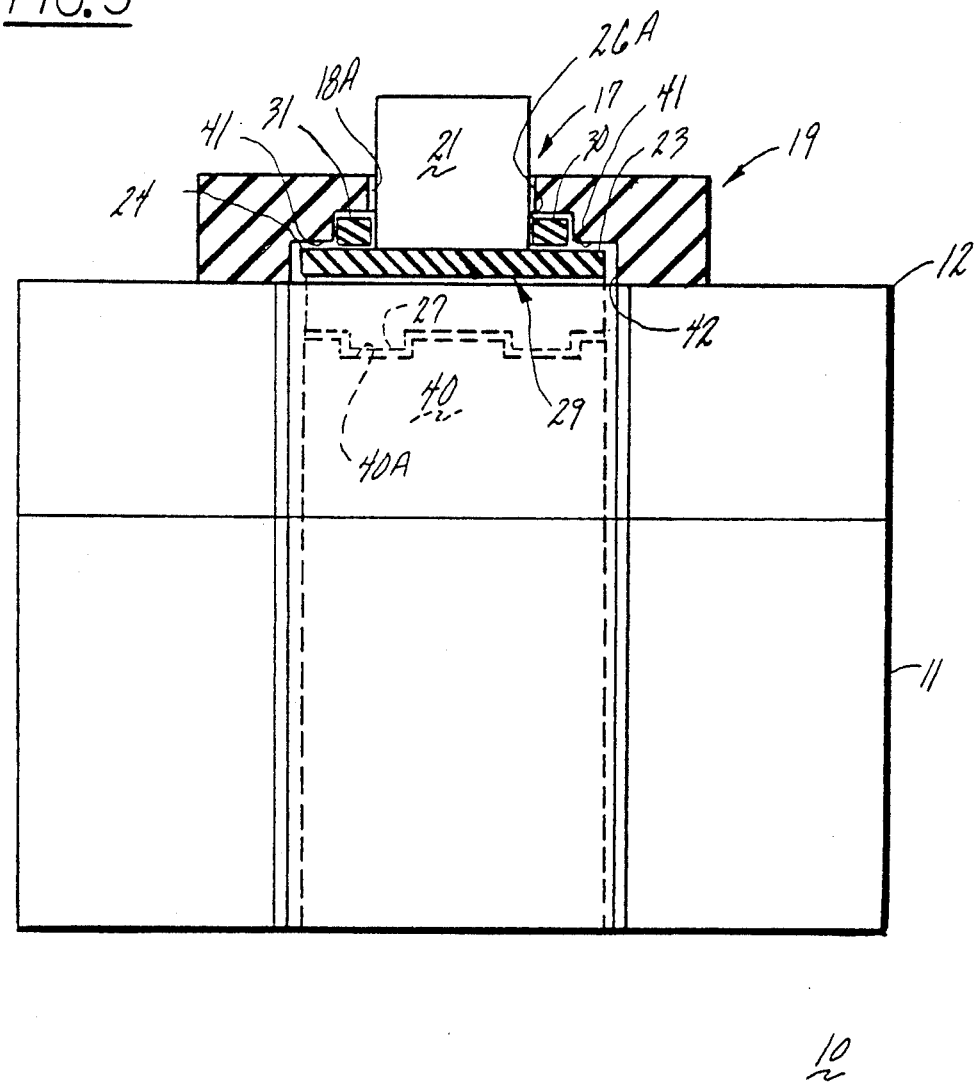
FIG. 5 is an enlarged end view of the electronic trip circuit breaker of FIG. 1 with the handle operator assembly and shutter in partial section.

As depicted in the electronic circuit breaker 10 shown in FIG. 5, the fastening of the circuit breaker cover 12 to the circuit breaker case 11 traps the operating handle assembly 17 and shutter 29 between the top of the handle yoke 40 and the tracks 41 formed on the bottom interior of the handle escutcheon 19 such that no other type fasteners are required. As the post 21 is reciprocated between its ON and OFF positions, the handle runners 23, 24 on the handle skirt move along the tracks 41 on the interior surface of the handle escutcheon while the shutter runners 30, 31 are guided between the sides 26A of the angulated part of the handle skirt and the edges 18A of the handle access slot. The attachment between the handle yoke 40 and the operating handle assembly by means of the projections 27 and slots 40A, described earlier, translates the motion of the handle post to the operating mechanism to move the circuit breaker contacts between their corresponding closed and open conditions.

Figure 6:
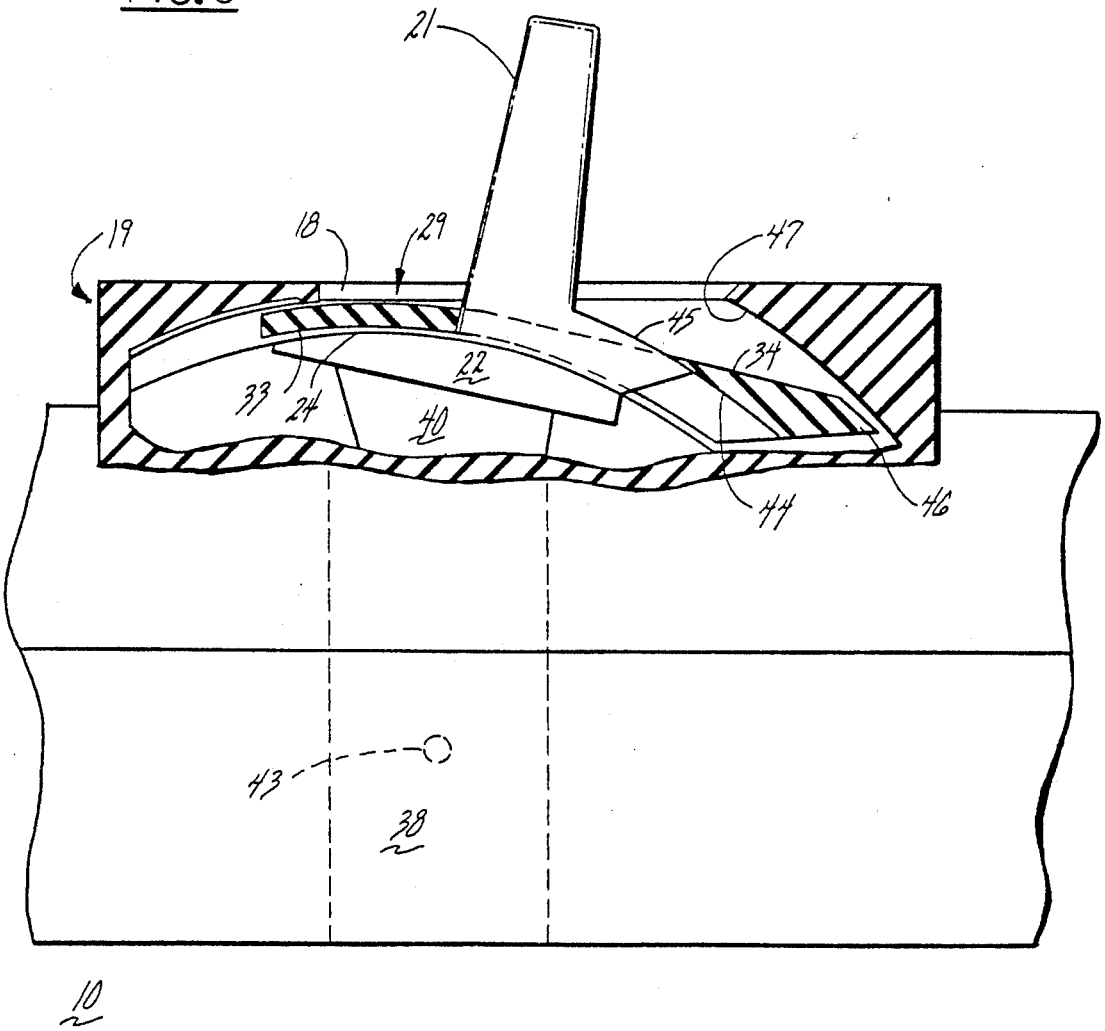
FIG. 6 is a further enlarged sectional view of the electronic trip circuit breaker of FIG. 1 taken through the plane 6—6.

The interaction between the geometry of the handle escutcheon 19, handle skirt 22 and shutter 29 is best seen by referring now to the circuit breaker 10 depicted in FIG. 6. The handle post 21 is shown extending through the handle slot 18 and is designed to travel within the slot by pivotal connection with the operating mechanism 38 by means of the handle yoke 40 and pivot pin 43. The extended length of travel of the handle post within the handle slot with the single shutter 29 is made possible by the various geometries imparted to the escutcheon 19, handle skirt 22, and shutter 29. As noted earlier, the radial bottom surface 33 on the shutter corresponds with the first radius that defines the radial surface of the outboard runners, one of which is depicted at 24. The second radius on the radial bottom surface 44 formed on the shutter corresponds to the second radial surface 45 formed on the handle skirt which provides for the motion of the handle skirt relative to the handle shutter. To provide for even further increased travel of the handle post 21 within the handle slot 18, the angulated part 46 at the end of the forward planar shelf 34 of the handle shutter is provided with a third radius that corresponds to the radius formed within the forward inner surface of the escutcheon as shown at 47. The third radius as measured from handle pivot is greater than the second radius, while the second radius is greater than the first radius to achieve the increased travel of the handle post.

As is well-known within the field of current limiting circuit interrupting devices, the greater the separation distance between the circuit breaker contacts, the longer the handle travel should be in order to move the contacts between their open and closed conditions. The aforementioned radial surfaces defined from the operating handle pivot accordingly provide a satisfactory reciprocal operating handle travel distance without allowing any of the gaseous by-products to transfer out from the circuit breaker through the handle aperture by use of a single shutter having the earlier described geometry.

Having thus described our invention, what we claim as new and desire to secure by Letters Patent is:

1. A molded case circuit breaker comprising:

a molded plastic circuit breaker case and cover;

an operating mechanism within said case arranged for separating a pair of contacts to interrupt current through a protected circuit;

a trip unit within said cover interacting with said operating mechanism to interrupt said circuit current upon occurrence of overcurrent conditions within said protected circuit;

an operating handle assembly operably connecting with said operating mechanism for manual separation of said contacts, said handle assembly including a plastic post upstanding from a plastic skirt, said skirt including a pair of handle runners arranged outboard said post, one of said handle runners carrying indicia providing visual indication of ON-OFF conditions of said contacts;

means defining a visual access slot formed in said circuit breaker cover over said indicia providing external viewing access to said indicia;

an escutcheon upstanding from a top surface of said circuit breaker cover, said escutcheon including an operating handle access slot;

a pair of rails formed on an inner surface of said escutcheon, said handle runners abutting said rails when said post is reciprocally moved within said operating handle access slot; and a shutter arranged over said handle skirt preventing egress of arc exhaust gases through said access slot said indicia being visible through said access slot outboard said shutter.

2. The circuit breaker of claim 1 wherein said handle skirt further includes an angulated part extending from a forward part of said post and a radial surface extending from a rear part of said post, said radial surface being lower than said angulated part.

3. A molded case circuit breaker comprising:

a molded plastic circuit breaker case and cover;

an operating mechanism within said case arranged for separating a pair of contacts to interrupt current through a protected circuit;

a trip unit within said cover interacting with said operating mechanism to interrupt said circuit current upon occurrence of overcurrent conditions within said protected circuit;

an operating handle assembly operably connecting with said operating mechanism for manual separation of said contacts, said handle assembly including a plastic post upstanding from a plastic skirt, said skirt including a pair of handle runners arranged outboard said post, one of said handle runners carrying indicia providing visual indication of ON-OFF conditions of said contacts;

means defining a visual access slot formed in said circuit breaker cover over said indicia providing external viewing access to said indicia;

an escutcheon upstanding from a top surface of said circuit breaker cover, said escutcheon including an operating handle access slot;

a pair of rails formed on an inner surface of said escutcheon, said handle runners abutting said rails when said post is reciprocally moved within said operating handle access slot;

a shutter arranged over said handle skirt preventing egress of arc exhaust gases through said operating handle access slot;

a rectangular slot in said shutter, said post extending through said rectangular slot when said shutter is arranged over said handle skirt; and a pair of shutter runners formed on said shutter outboard said rectangular slot, said shutter including a planar top surface and a first radial bottom surface having a first radius, said top surface being arranged beneath a part of said operating handle access slot and said bottom surface being arranged over said radial surface on said handle skirt to thereby allow reciprocal travel of said post within said rectangular slot and said operating handle access slot without egress of said arc exhaust gases through said operating handle access slot.

4. The circuit breaker of claim 3 including a pair of guides formed on said escutcheon inner surface subajacent said rails, said shutter runners being slidably retained between said handle skirt and said guides to guide said shutter runners when said post is reciprocally moved within said rectangular slot and said access slot.

5. The circuit breaker of claim 3 wherein said angulated part of said handle shutter extends through a part of said rectangular slot in a press-fit relation.

6. The circuit breaker of claim 5 wherein said s further includes a second radial bottom surface having a second radius corresponding to a second radial surface on said handle skirt to further increase the travel of said handle post.

7. The circuit breaker of claim 6 wherein said angulated part comprises a third radius corresponding to a third radius on said inner surface of said escutcheon to provide even further increased travel to said handle post.

8. The circuit breaker of claim 7 wherein said second radius is greater than said first radius.

9. The circuit breaker of claim 7 wherein said third radius is greater than said second radius.

* * * * *

UNITED STATES PATENT AND TRADEMARK OFFICE

CERTIFICATE OF CORRECTION

PATENT NO. : 5,038,121

DATED : August 6, 1991

INVENTOR(S) : Fraulo et al.

It is certified that error appears in the above-identified patent and that said Letters Patent is hereby corrected as shown below:

Col. 6, line 20, after "said" delete "s" and insert --shutter--.

Signed and Sealed this

Eighth Day of December, 1992

*Attest:*

DOUGLAS B. COMER

*Attesting Officer*

*Acting Commissioner of Patents and Trademarks*